United States Patent [19]

Myohl et al.

[11] Patent Number: 4,926,887

[45] Date of Patent: May 22, 1990

[54] APPARATUS FOR MANIPULATING ROD-SHAPED ARTICLES

[75] Inventors: Jochim Myohl, Wentorf; Alfred Kasparek, Hamburg, both of Fed. Rep. of Germany

[73] Assignee: Körber AG, Hamburg, Fed. Rep. of Germany

[21] Appl. No.: 291,511

[22] Filed: Dec. 29, 1988

[30] Foreign Application Priority Data

Jan. 9, 1988 [DE] Fed. Rep. of Germany ..... 3800431

[51] Int. Cl.[5] ..... A24C 5/28

[52] U.S. Cl. ..... 131/91; 131/94; 131/282; 493/45

[58] Field of Search ..... 131/282, 84.1, 84.4, 131/91, 94; 493/45, 39, 42

[56] References Cited

U.S. PATENT DOCUMENTS 3,518,911 7/1970 Niemann et al. ..... 131/84.1

FOREIGN PATENT DOCUMENTS 0241325 11/1962 Australia ..... 131/65
1757144 2/1971 Fed. Rep. of Germany ..... 131/84.1
2549512 5/1987 Fed. Rep. of Germany ..... 131/84.1

*Primary Examiner*—V. Millin
*Attorney, Agent, or Firm*—Peter K. Kontler

[57] ABSTRACT

Apparatus for manipulating plain cigarettes between the cutoff of a cigarette making machine and the next-following machine, such as a filter tipping machine, has an elongated guide with a prismatic channel for advancement of successive plain cigarettes along a path which is open from above. In order to prevent the cigarettes from rising in the guide, a stabilizing element in the form of an inverted channel-shaped member is placed in front of the guide at a level above the path of cigarettes and downstream of the last tube of the cutoff.

9 Claims, 1 Drawing Sheet

APPARATUS FOR MANIPULATING ROD-SHAPED ARTICLES

BACKGROUND OF THE INVENTION

The invention relates to improvements in apparatus for manipulating rod-shaped articles which move axially in the form of a file of aligned articles. Typical examples of such articles are plain cigarettes or filter rod sections which are obtained as a result of repeated severing of a continuous cigarette rod or filter rod and are to be transported to storage, to a packing machine or to a filter tipping machine.

Commonly owned published German patent application No. 1 757 144 discloses a guide which extends between the cutoff of a cigarette rod making machine and a filter tipping machine and defines an elongated path for a file of discrete plain cigarettes which are to be assembled with filter mouthpieces to form filter cigarettes of unit length or multiple unit length. A drawback of heretofore known guides for files of aligned axially moving rod-shaped articles, such as plain cigarettes, is that the articles tend to rise and thus leave the prescribed path when their speed reaches a certain value. Such rising of articles is highly undesirable because it can result in pileups and lengthy interruptions of delivery of articles to the next processing station. Any, even shortest, interruptions of delivery of articles in a modern filter tipping or an analogous high-speed machine can result in huge losses in output because a modern filter tipping machine (such as that known as MAX which is produced by the assignee of the present application) can turn out many thousands of filter cigarettes per minute.

OBJECTS OF THE INVENTION

An object of the invention is to provide an apparatus which serves to manipulate rod-shaped articles, particularly plain cigarettes, in such a way that the articles advance axially in the form of a file and are compelled to remain in a predetermined path.

Another object of the invention is to provide the apparatus with novel and improved means for stabilizing the articles in their path, even if the articles are caused to move axially at an elevated speed which would result in unpredictable guidance of articles, or no guidance at all, in heretofore known apparatus.

A further object of the invention is to provide an apparatus wherein the stabilizing means is installed in an optimum position with reference to the guide.

An additional object of the invention is to provide a novel and improved combination of a guide for axially advancing rod-shaped articles, a stabilizing element for the articles, and a device for subdividing a continuous rod (such as a cigarette rod) in order to form a series of aligned rod-shaped articles.

Still another object of the invention is to provide a novel and improved method of preventing axially advancing rod-shaped articles, which form a file of aligned articles, from leaving their prescribed path in an open-top channel.

SUMMARY OF THE INVENTION

The invention resides in the provision of an apparatus for manipulating a series of rod-shaped articles which move axially, particularly for manipulating rod-shaped articles of the tobacco processing industry which are severed from a moving continuous rod. The improved apparatus comprises a guide defining for the articles of the series an elongated path which is open at one side and which the articles tend to leave when moving at an elevated speed, and means for stabilizing the articles in the path including a stabilizing element which is disposed outside the path and serves to at least reduce the tendency of the articles to leave the path while moving longitudinally at the elevated speed.

The guide can include a rail having a channel for the articles in the path. The channel can have a polygonal (e.g., a triangular) cross-sectional outline. The rail can be provided with suction ports which communicate with the channel, and the apparatus then further comprises means for evacuating air from the channel by way of the suction ports so that the articles in the path are attracted to the surface bounding the channel. The open side of the path is normally the upper side, i.e., the channel has an open top. The stabilizing element is preferably disposed at a level above and in front of the article-receiving end of the path.

The apparatus can further comprise means for subdividing a rod into discrete rod-shaped articles ahead of the path. The subdividing means can comprise tubular guides for the rod and a knife which is movable relative to the tubular guides and serves to repeatedly sever the rod. The tubular guides include a first tubular guide which is nearer to and a second tubular guide which is more distant from the path. The stabilizing element is preferably disposed between the path and the first tubular guide.

The stabilizing element can define a second channel for portions of successive articles of the series. The arrangement is preferably such that successive increments of an article advance along the channel of the stabilizing element prior to entering the channel of the guide which defines the aforementioned path.

The length of the stabilizing element can be small, actually a minute, fraction of the length of the guide, as considered in the longitudinal direction of the path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
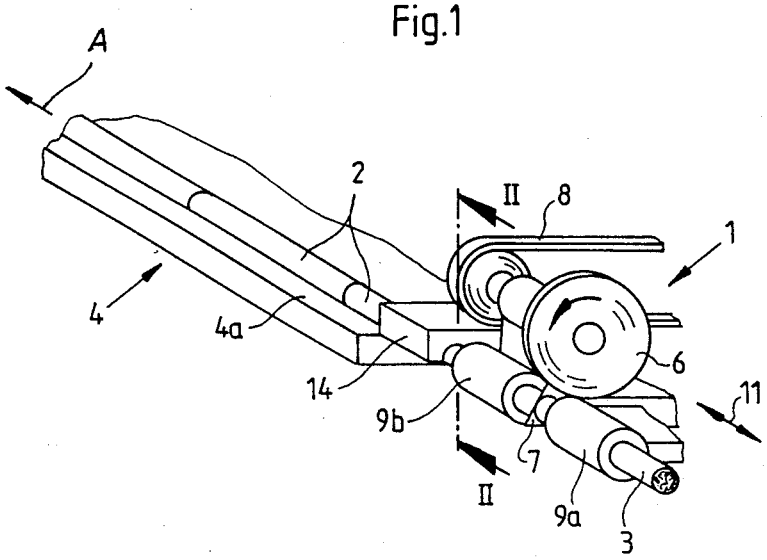
FIG. 1 is a perspective view of an apparatus which forms part of a cigarette rod making machine and embodies one form of the invention.
Figure 2:
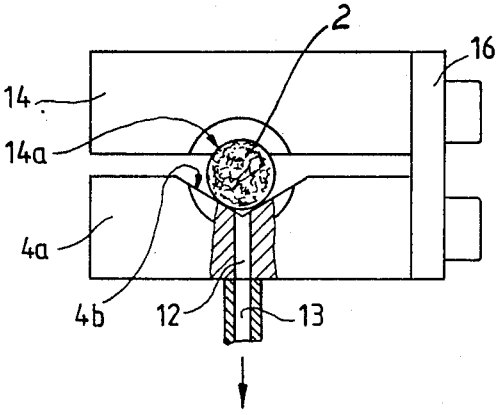
FIG. 2 is an enlarged transverse vertical sectional view as seen in the direction of arrows from the line II—II of FIG. 1.

The apparatus which is shown in FIGS. 1 and 2 forms part of a cigarette rod making machine, e.g., a machine known as PROTOS which is produced by the assignee of the present application. The apparatus comprises a severing or subdividing device 1 (also known as cutoff) which serves to subdivide a continuous cigarette rod 3, moving in the direction of arrow A, into a series or file of aligned plain cigarettes 2 of unit or multiple unit length. The severing or subdividing device 1 (hereinafter called cutoff) comprises two coaxial and slightly spaced apart tubular guides 9a, 9b for the cigarette rod 3, a rotary knife holder 6, an orbiting knife 7 which is mounted on the holder 6 and is located between the tubular guides 9a, 9b, and a drive 8 which rotates the holder 6 and the knife 7 at a speed to subdivide the rod 3 into a series of plain cigarettes (rod-shaped articles) 2 of desired length. The double-headed arrow 11 indicates the directions in which the tubular guides 9a, 9b are reciprocable by a conventional drive (not shown) when the cutoff 1 is in use. When the knife 7 is about to sever the rod 3 in the space between the tubular guides 9a and 9b, these guides advance with the holder 6 in the direction of arrow A at the exact speed of the rod 3 so as to ensure that the knife 7 can form a cut in a plane extending at right angles to the axis of the rod 3. Reference may be had, for example, to U.S. Pat. No. 3,518,911 to Niemann et al. which describes a suitable cutoff. The tubular guides 9a, 9b prop the advancing rod 3 ahead of and behind the cutting plane.

The apparatus further comprises an elongated substantially trough-shaped guide 4 which serves to define an elongated path for advancement of the file of cigarettes 2 to the next processing station, e.g., to storage, to a packing machine or to a filter tipping machine. For example, the guide 4 can deliver successive cigarettes 2 to a drum-shaped conveyor which has axially parallel peripheral flutes for discrete plain cigarettes or for pairs of plain cigarettes and serves to convert the single file of aligned cigarettes into one or more rows wherein the cigarettes advance at right angles to their respective axes in a manner as normally required in a packing or filter tipping machine. A suitable drum-shaped direction-changing conveyor is disclosed in the aforementioned commonly owned published German patent application No. 1 757 144. It is also possible to employ the guide 4 as a means for delivering successive cigarettes 2 to a station where the cigarettes are removed from their path by a suitable conveyor which transfers them into the axially peripheral flutes of a rotary drum-shaped conveyor, e.g., in a manner as disclosed in commonly owned German Pat. No. 25 49 512. In either event, cigarettes which move sideways can be processed in a filter tipping machine (such as the aforementioned MAX) or in a packing machine, depending upon whether the cigarettes are to be assembled with filter mouthpieces or are to be packed in the form of plain cigarettes.

The illustrated guide 4 includes or constitutes an elongated rail 4a which has an upper side formed with an elongated channel 4b having a polygonal (e.g., triangular) cross-sectional outline. The top side of the channel 4b is open, i.e., one side of the path which is defined by the rail 4a is open so that, when the speed of cigarettes 2 reaches a predetermined value, the cigarettes tend to rise off the rail 4a and to thus leave the prescribed path for advancement to the next processing station. This can result in a pileup of cigarettes and can entail lengthy stoppages of the filter tipping or packing machine as well as of the cigarette rod making machine.

The rail 4a is formed with a series of preferably equidistant suction ports 12 (one shown in FIG. 2) which communicate with the deepmost portion of the channel 4b and are connected with pipes 13 which serve to draw air from the channel 4b and to thus attract the cigarettes 2 to the rail 4a. The pipes 13 are connected to the suction intake of a fan (not shown) or any other suitable suction generating device. It has been found that the provision of means for pneumatically attracting cigarettes 2 to the surfaces bounding the channel 4b does not suffice to ensure retention of cigarettes in the channel 4b when the axial speed of the cigarettes exceeds a certain value which is normally reached or exceeded when the cigarettes are produced in a modern high-speed cigarette making machine (such as the aforementioned PROTOS of applicant).

In order to prevent cigarettes 2 from rising above the rail 4a, the improved apparatus further comprises a stabilizing element 14 which resembles an inverted trough and is disposed between the receiving end of the path for the cigarettes 2 (i.e., between the rear end of the channel 4b) and the adjacent tubular guide 9b of the cutoff 1. The underside of the stabilizing element 14 is formed with a channel 14a which receives the topmost portions of successive increments of freshly severed cigarettes 2 before the lowermost portions of such increments enter the adjacent rear end of the channel 4b. The stabilizing element 14 is much shorter than the guide 4 and is separably or permanently affixed to a carrier 16 which, in turn, can be affixed to the guide 4.

FIG. 2 shows that the stabilizing element 14 is disposed in a plane above the plane of the rail 4a and nearly entirely above the plane of the file of cigarettes 2 in the path which is defined by the rail 4a. The element 14 is sufficiently close to the rail 4a to ensure that an article 2 leaving the cutoff 1 is engaged from below by the guide 4 and is simultaneously engaged from above by, or is at least very close to, the element 14.

It has been found that the element 14 can produce a desirable stabilizing action even if its length (in the longitudinal direction of the path for the cigarettes 2) is only a small or minute fraction of the length of the guide rail 4a.

An important advantage of the improved apparatus is that it ensures retention of cigarettes 2 in their prescribed path, even if the cigarettes are caused to move axially at a speed which is excessive for proper control of cigarettes in conventional guides.

Another advantage of the illustrated apparatus is that the space between the tubular guide 9b and the channel 4b suffices to permit gravitational descent of fragments of a cigarette rod which develop during each starting of the rod making machine and which would otherwise enter the channel 4b for transport to the next processing station. Such fragments remain in or adhere to the guide of a conventional apparatus.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for manipulating a series of rod-shaped articles which move axially, particularly for manipulating rod-shaped articles of the tobacco processing industry which are severed from a moving continuous rod, comprising a guide having a channel defining for the articles of the series an elongated path which is open at one side and which the articles tend to leave when moving at an elevated speed, said path having an article-receiving end and said open side being the upper side of said path; and means for stabilizing the articles in said path, including a stabilizing element disposed at a level above the article-receiving end of said path and arranged to at least reduce the tendency of the articles to leave said path while moving longitudinally at said elevated speed.

2. The apparatus of claim 1, wherein said guide includes a rail.

3. The apparatus of claim 1, wherein said channel has a polygonal cross-sectional outline.

4. The apparatus of claim 2, wherein said rail has suction ports communicating with said channel and further comprising means for evacuating air from said channel by way of said ports.

5. The apparatus of claim 1, further comprising means for subdividing a rod into discrete rod-shaped articles ahead of said path, said subdividing means including tubular guides for the rod and a knife which is movable relative to said tubular guides and is arranged to repeatedly sever the rod.

6. The apparatus of claim 5, wherein said tubular guides include a first tubular guide nearer to and a second tubular guide more distant from said path, said stabilizing element being disposed between said path and said first tubular guide.

7. The apparatus of claim 1, wherein said stabilizing element defines a channel for portions of successive articles of said series.

8. The apparatus of claim 1, wherein said guide is elongated and the length of said stabilizing element in the longitudinal direction of said path is less than the length of said guide.

9. The apparatus of claim 1, wherein said stabilizing element is disposed in front of the article-receiving end of said path.

* * * * *